US009086680B2

(12) United States Patent
Takahashi

(10) Patent No.: US 9,086,680 B2
(45) Date of Patent: Jul. 21, 2015

(54) IMAGE FORMING APPARATUS WITH COOLING AIR CHANNELS ARRANGED IN AN INTERNAL SPACE OF THE IMAGE FORMING APPARATUS

(71) Applicant: KYOCERA Document Solutions Inc., Osaka-shi, Osaka (JP)

(72) Inventor: Satoru Takahashi, Osaka (JP)

(73) Assignee: KYOCERA DOCUMENT SOLUTIONS INC. (JP)

( * ) Notice: Subject to any disclaimer, the term of this patent is extended or adjusted under 35 U.S.C. 154(b) by 112 days.

(21) Appl. No.: 13/685,932

(22) Filed: Nov. 27, 2012

(65) Prior Publication Data

US 2013/0136485 A1 May 30, 2013

(30) Foreign Application Priority Data

Nov. 30, 2011 (JP) ..... 2011-261895

(51) Int. Cl.
*G03G 21/20* (2006.01)

(52) U.S. Cl.
CPC ..... *G03G 21/206* (2013.01)

(58) Field of Classification Search
CPC ..... G03G 15/2017; G03G 15/2021; G03G 15/206; G03G 21/206; G03G 2221/1645
See application file for complete search history.

(56) References Cited

U.S. PATENT DOCUMENTS

| | | | | |
|---|---|---|---|---|
| 4,285,780 | A * | 8/1981 | Schachter | 205/120 |
| 5,510,827 | A * | 4/1996 | Kubota et al. | 347/257 |
| 6,205,302 | B1 * | 3/2001 | Yokota | 399/92 |
| 7,469,112 | B2 * | 12/2008 | Yuasa | 399/92 |
| 2004/0096229 | A1 * | 5/2004 | Yoshihara et al. | 399/33 |
| 2004/0130700 | A1 | 7/2004 | Ogi et al. | |
| 2007/0092297 | A1 * | 4/2007 | Shimura et al. | 399/167 |
| 2010/0098451 | A1 | 4/2010 | Tsusaka et al. | |
| 2011/0123230 | A1 * | 5/2011 | Suenami et al. | 399/254 |

FOREIGN PATENT DOCUMENTS

| | | |
|---|---|---|
| JP | H8-022237 | 1/1996 |
| JP | 2001-194980 | 7/2001 |
| JP | 2002-99124 | 4/2002 |
| JP | 2006-119234 | 5/2006 |
| JP | 2006119234 A * | 5/2006 |

(Continued)

OTHER PUBLICATIONS

Japanese Office Action—Jun. 17, 2014.

*Primary Examiner* — Clayton E Laballe
*Assistant Examiner* — Victor Verbitsky
(74) *Attorney, Agent, or Firm* — Gerald E. Hespos; Michael J. Porco; Matthew T. Hespos

(57) ABSTRACT

An image forming apparatus includes a chassis, an image forming section, a fan, a circuit board, and a first cooling air channel. The chassis includes a first surface and a second surface that is opposite to the first surface. The image forming section is arranged in an internal space formed between the first surface and the second surface of the chassis and performs an image forming process on a sheet. The fan is arranged between the first surface and the image forming section and is rotationally driven to cause an airflow to flow into the internal space. The circuit board is vertically arranged between the second surface and the image forming section. The first cooling air channel is arranged in the internal space and sends the airflow toward the circuit board.

9 Claims, 12 Drawing Sheets

(56) References Cited

FOREIGN PATENT DOCUMENTS

| | | | | | |
|---|---|---|---|---|---|
| JP | 2006239876 | 9/2006 | JP | 2007140288 A | * 6/2007 |
| | | | JP | 2008268529 A | * 11/2008 |
| | | | JP | 2010044157 A | * 2/2010 |

* cited by examiner

IMAGE FORMING APPARATUS WITH COOLING AIR CHANNELS ARRANGED IN AN INTERNAL SPACE OF THE IMAGE FORMING APPARATUS

This application is based on, and claims priority from, Japanese Patent Application No. 2011-261895, filed on Nov. 30, 2011 with the Japan Patent Office, the entire contents of which are incorporated herein by reference.

BACKGROUND

The present disclosure relates to an image forming apparatus that performs an image forming process on a sheet and, in particular, to an image forming apparatus having a cooling air channel that cools the interior of the apparatus.

An image forming apparatus has various components, members, and devices that include such components or members, which act as heat sources. Examples of thereof include a power substrate mounted with a power semiconductor element and a fixing device that performs a fixing process on a sheet onto which a toner image has been transferred. In order to discharge heat generated by these heat source devices to the outside, the image forming apparatus is provided with a air duct.

Generally, a fan is attached to an end of the aforementioned duct in order to promote heat discharge. By activating the fan, an airflow is generated within the duct and warm air inside the apparatus is discharged to the outside by the airflow. Conventionally, an image forming apparatus is known which divides an airflow caused by an intake operation of the fan into a flow in a direction of a fixing section and a flow in a direction of a power-supply unit.

In the conventional art described above, a heat source device such as the power-supply unit and a control substrate is arranged approximately horizontally inside a main body of the apparatus and a fan is arranged adjacent to a heat source device. When various substrates are arranged approximately horizontally in an internal space of the apparatus main body in this manner, a space in a height direction of the apparatus main body becomes individually occupied. In addition, since arranging a fan arranged adjacent to a heat source device limits an arrangement space of the fan, a small-size fan tends to be selected. In this case, there is a problem in that rotating a small-size fan at high speed in order to generate an airflow results in generating noise.

The present disclosure has been made in consideration of the problem described above and an object of the present disclosure is to reduce noise caused by a fan that generates an airflow inside an apparatus.

SUMMARY

An image forming apparatus according to an aspect of the present disclosure includes a chassis, an image forming section, a fan, a circuit board, and a first cooling air channel. The chassis includes a first surface and a second surface that is opposite to the first surface. The image forming section is arranged in an internal space formed between the first surface and the second surface of the chassis and performs an image forming process on a sheet. The fan is arranged between the first surface and the image forming section and is rotationally driven to cause an airflow to flow into the internal space. The circuit board is vertically arranged between the second surface and the image forming section. The first cooling air channel is arranged in the internal space and sends the airflow toward the circuit board.

DETAILED DESCRIPTION

Figure 1:
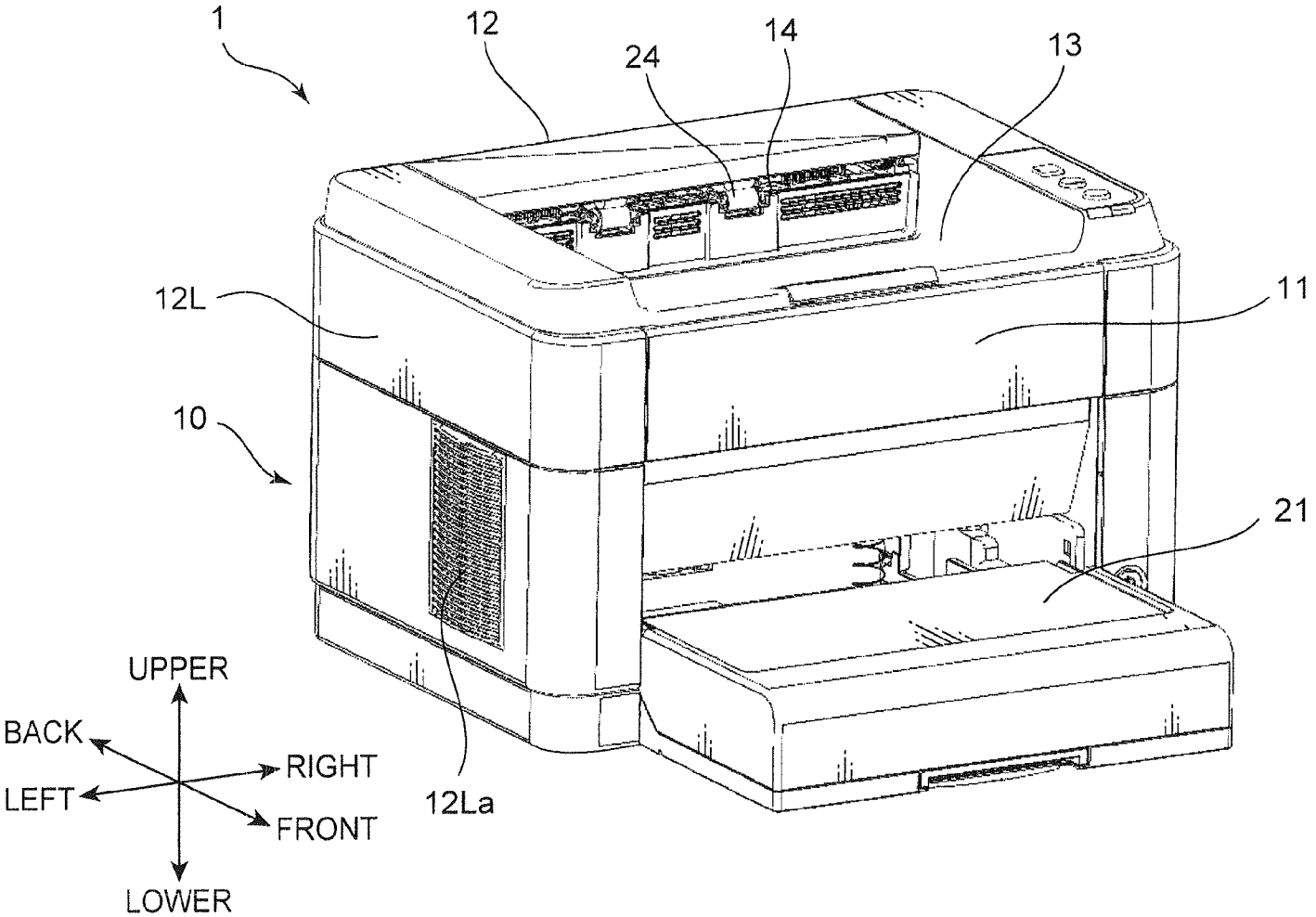
FIG. 1 is a perspective view showing an exterior of an image forming apparatus according to an embodiment of the present disclosure.
Figure 2:
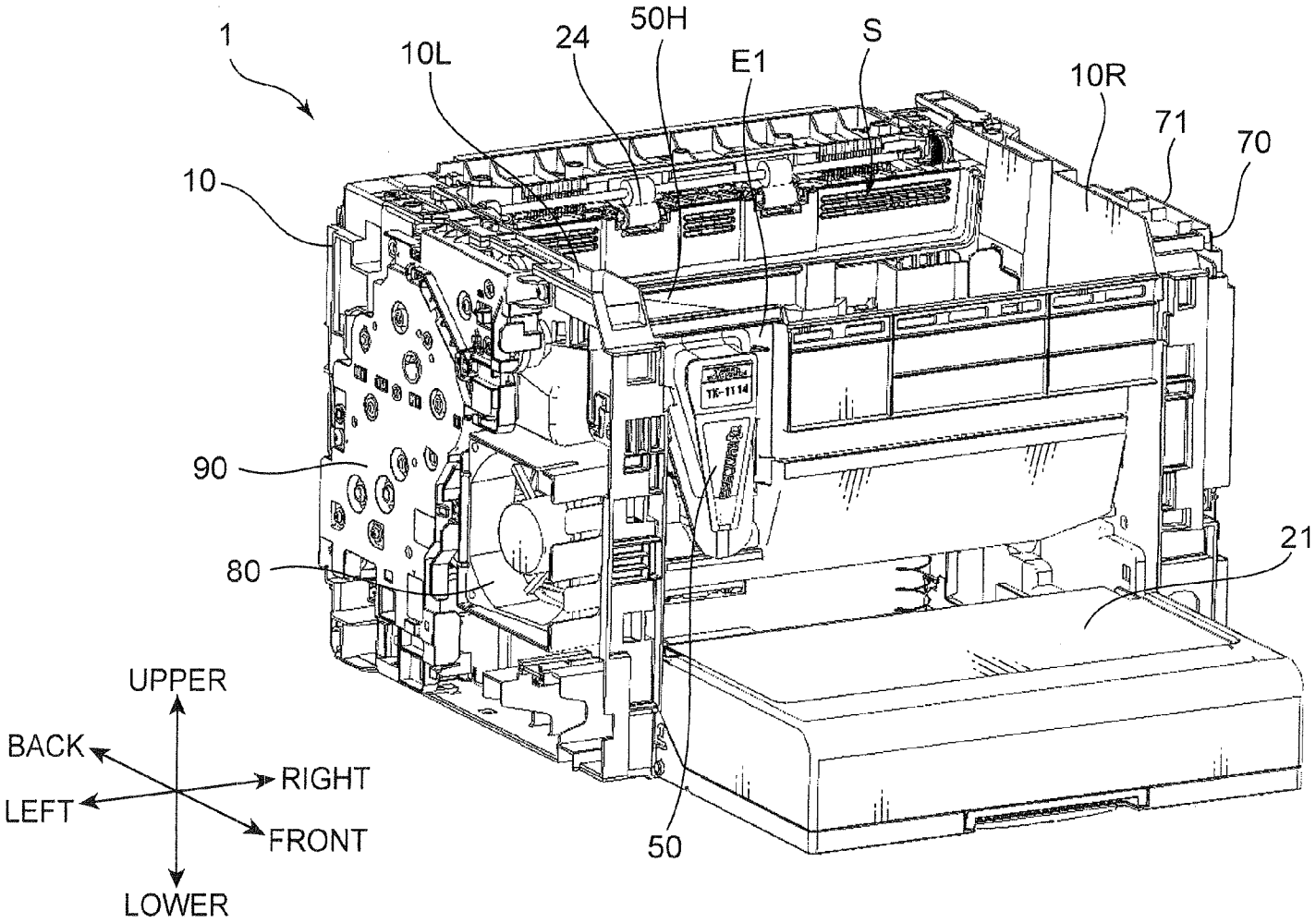
FIG. 2 is a perspective view showing an internal structure of the image forming apparatus according to an embodiment of the present disclosure.
Figure 3:
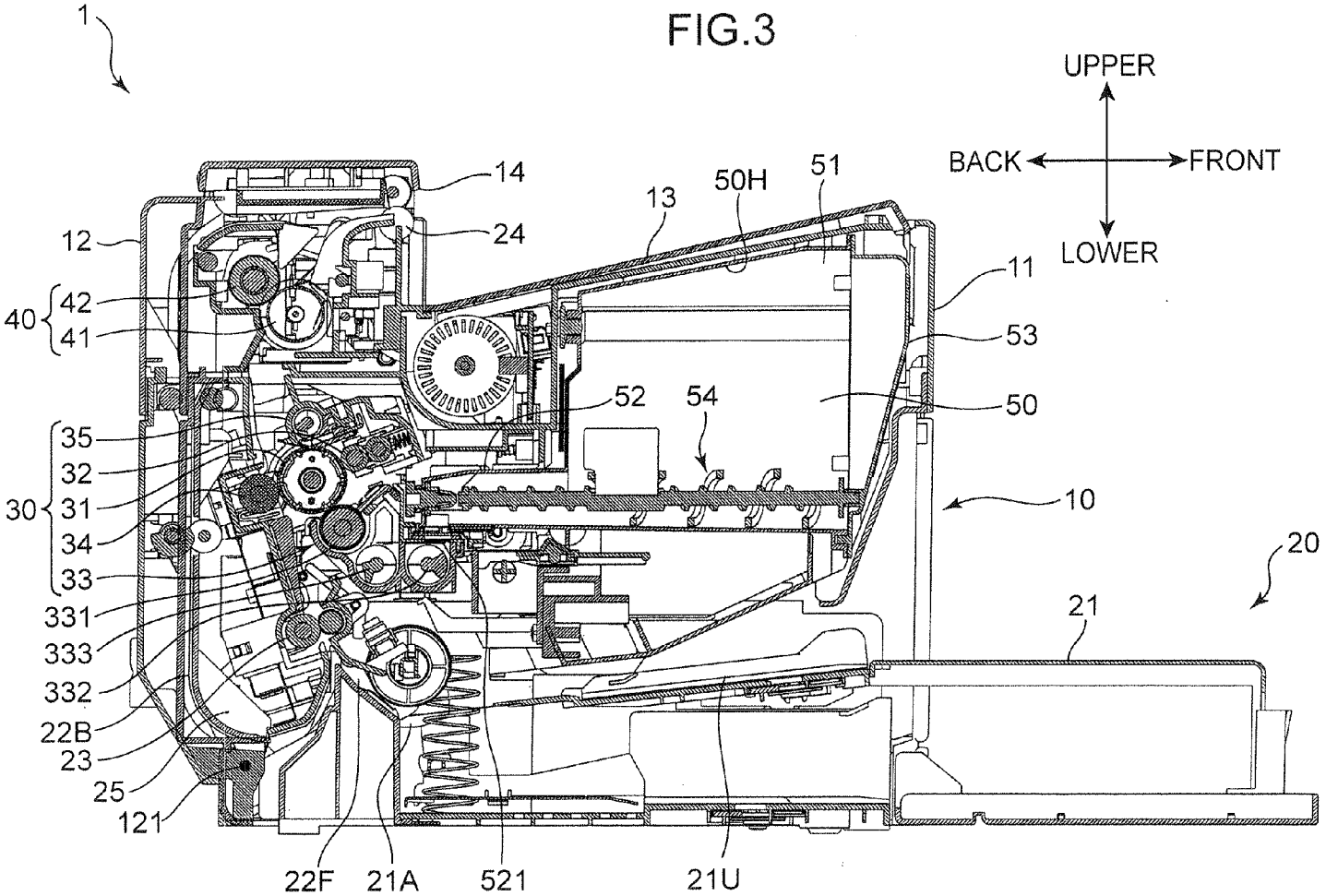
FIG. 3 is a side sectional view showing the internal structure of the image forming apparatus according to an embodiment of the present disclosure.
Figure 4:
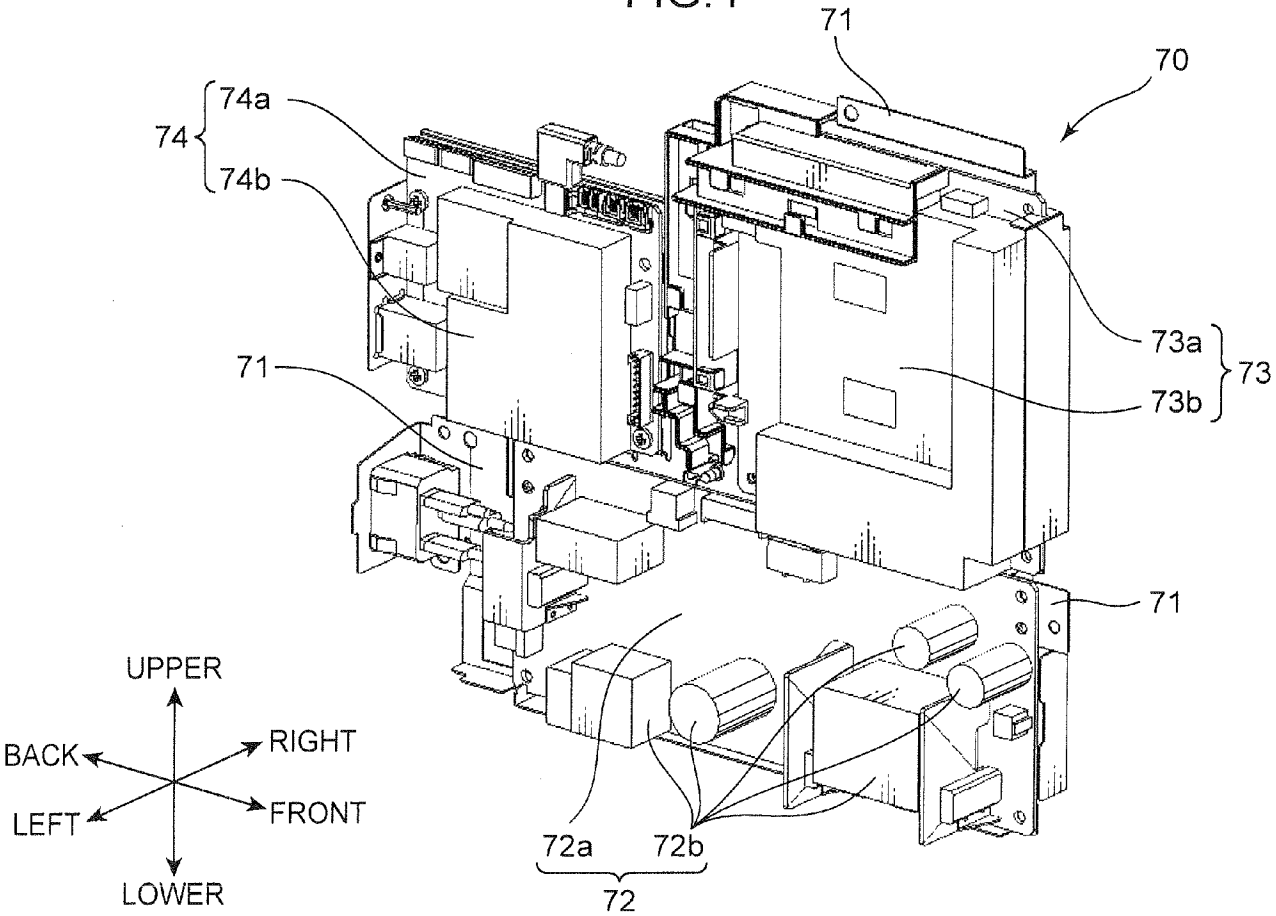
FIG. 4 is a perspective view showing an exterior of a substrate unit according to an embodiment of the present disclosure.

Hereinafter, embodiments of the present disclosure will be described in detail with reference to the drawings. Moreover, while arrows indicating front and back, up and down, and left and right are provided in the drawings in order to describe an image forming apparatus 1 according to the present embodiment, orientations of the image forming apparatus 1 are not limited thereto. FIG. 1 is a perspective view showing an exterior of the image forming apparatus 1 according to an embodiment of the present disclosure. In addition, FIG. 2 is a perspective view showing an internal structure of the image forming apparatus 1 according to an embodiment of the present disclosure. FIG. 2 shows a state where respective covers and an image forming section 30 (to be described later) have been removed in FIG. 1. Furthermore, FIG. 3 is a side sectional view showing the internal structure of the image forming apparatus 1 according to an embodiment of the present disclosure. FIG. 4 is a perspective view showing a configuration of a substrate unit 70. While a black-and-white printer will be exemplified herein as the image forming apparatus 1, the image forming apparatus may alternatively be a copier, a facsimile machine, or a multifunction printer that combines functions of a copier and a facsimile machine. Furthermore, an image forming apparatus that forms color images may also be adopted.

The image forming apparatus 1 includes a main body housing 10 (chassis) which has a chassis structure with an approximately rectangular parallelepiped shape, a paper feeding section 20 housed inside the main body housing 10, an image forming section 30, a fixing section 40, a toner container 50 (toner housing section), a substrate unit 70, and a cooling fan 80.

A front cover 11 is provided on a front side and a rear cover 12 is provided on a rear side of the main body housing 10. Opening the front cover 11 exposes the toner container 50 as shown in FIG. 2. Accordingly, when toner runs out, a user can take out the toner container 50 from the front side of the main body housing 10. The rear cover 12 is a cover that is opened in the event of a sheet jam or upon maintenance. By opening the rear cover 12, the image forming section 30 and the fixing section 40 can respectively be taken out from the rear side of the main body housing 10. In addition, a left cover 12L (FIG. 1) (first surface) and a right cover 12R (not shown in FIG. 1) (second surface) on an opposite side to the left cover 12L are respectively provided on side surfaces of the main body housing 10 so as to extend in a vertical direction. An air inlet 12La that is used by the cooling fan 80 (to be described later) to take in air is arranged on a front-side portion of the left cover 12L. Furthermore, a paper ejecting section 13 on which a sheet after image formation is ejected is provided on an upper surface of the main body housing 10. Various devices for executing image formation are mounted inside an internal space S (FIG. 2) that is defined by the front cover 11, the rear cover 12, the left cover 12L, the right cover 12R, and the paper ejecting section 13.

A left frame 10L and a right frame 10R which become exposed by removing the front cover 11, the rear cover 12, the left cover 12L, and the right cover 12R are erected inside the main body housing 10 (FIG. 2). The left frame 10L supports various devices on the side of the left cover 12L of the main body housing 10. In addition, the right frame 10R supports various devices on the side of the right cover 12R of the main body housing 10. The image forming section 30 and the fixing section 40 which extend in a horizontal direction are supported by the left frame 10L and the right frame 10R.

The paper feeding section 20 includes a paper cassette 21 that houses sheets on which an image forming process is performed (FIG. 3). The paper cassette 21 is attachable/detachable to/from the main body housing 10. A part of the paper cassette 21 protrudes forward from the front of the main body housing 10. In the paper cassette 21, an upper surface of a portion housed inside the main body housing 10 is covered by a paper cassette top plate 21U. The paper cassette 21 has a sheet housing space that houses a stack of the sheet described above, and is provided with a lift plate that lifts up the sheet stack when feeds paper, and the like. A sheet feeding section 21A is provided in an upper part on a rear end side of the paper cassette 21. A pickup roller (not shown) for feeding one sheet at a time from the top of the sheet stack in the paper cassette 21 is arranged in the sheet feeding section 21A.

The image forming section 30 performs an image forming process in which a toner image is formed on a sheet that is sent out from the paper feeding section 20. The image forming section 30 includes a photosensitive drum 31 (image carrier), and a charging device 32, an exposure device (not shown in FIG. 3), a developing device 33, a transfer roller 34, and a cleaning device 35 which are arranged around the photosensitive drum 31. The image forming section 30 is arranged between the left cover 12L (first surface) and the right cover 12R (second surface) or, more specifically, between the left frame 10L and the right frame 10R.

As the photosensitive drum 31 rotates around a shaft thereof, an electrostatic latent image and a toner image are formed on a circumferential surface thereof. A photosensitive drum made of an amorphous silicon (a-Si) based material can be used as the photosensitive drum 31. The charging device 32 uniformly charges a surface of the photosensitive drum 31 and includes a charging roller that abuts the photosensitive drum 31. The cleaning device 35 includes a cleaning roller and the like, and cleans toner attached to the circumferential surface of the photosensitive drum 31 after a toner image has been transferred and conveys the toner to a recovery device (not shown). In addition, the photosensitive drum 31, the charging device 32, and the cleaning device 35 are integrally constructed as a drum unit 30H (refer to FIG. 10) (image carrier unit).

The exposure device includes a laser light source and an optical system device such as a mirror or a lens, and irradiates the circumferential surface of the photosensitive drum 31 with laser light modulated based on image data supplied from an external device such as a personal computer in order to form an electrostatic latent image. The developing device 33 supplies toner to the circumferential surface of the photosensitive drum 31 in order to develop the electrostatic latent image on the photosensitive drum 31 to form a toner image. The developing device 33 includes a developing roller 331 that carries toner to be supplied to the photosensitive drum 31, and a first conveying screw 332 and a second conveying screw 333 which circulate and convey a developer while agitating the developer inside a development housing (not shown).

The transfer roller 34 is a roller for transferring a toner image formed on the circumferential surface of the photosensitive drum 31 onto a sheet, and forms a transfer nip section together with the photosensitive drum 31. A transfer bias with a reverse polarity to the toner is applied to the transfer roller 34.

The fixing section 40 (fixing unit) performs a fixing process for fixing a transferred toner image onto a sheet. The fixing section 40 includes a fixing roller 41 provided with an internal heat source and a pressure roller 42 which is pressed against the fixing roller 41 and which forms a fixing nip section together with the fixing roller 41. When a sheet onto which a toner image has been transferred is sent to the fixing nip section, the toner image is fixed onto the sheet by heating applied by the fixing roller 41 and pressure applied by the pressure roller 42.

The toner container 50 (toner housing section) stores toner that is supplied to the developing device 33. The toner container 50 includes a container main body 51 that is a primary storage location of toner, a cylindrical section 52 that extends from a lower part of one side surface of the container main body 51, a lid member 53 that covers the other side surface of the container main body 51, a rotating member 54 which is housed inside the container and which conveys toner, and a container top plate 50H that covers the toner container 50 from above. When the rotating member 54 is rotationally driven, the toner stored inside the toner container 50 is supplied to the inside of the developing device 33 through a toner outlet 521 provided on a lower surface of a tip of the cylindrical section 52. In addition, the toner container 50 is arranged at a position that is above and immediately to the right (inward) of the left frame 10L (FIG. 2). Furthermore, the container top plate 50H is positioned below the paper ejecting section 13 (refer to FIG. 3).

A main conveying path 22F and a reverse conveying path 22B are provided inside the main body housing 10 for conveying sheet. The main conveying path 22F extends from the sheet feeding section 21A of the paper feeding section 20 to a paper outlet 14 provided so as to oppose the paper ejecting section 13 on the upper surface of the main body housing 10 via the image forming section 30 and the fixing section 40.

The reverse conveying path 22B is a conveying path that is used when performing duplex printing on a sheet in order to return a sheet printed on one side to an upstream position along the main conveying path 22F with respect to the image forming section 30.

A resist roller pair 23 is arranged on an upstream side of the transfer nip section constituted by the photosensitive drum 31 and the transfer roller 34 along the main conveying path 22F. A sheet is stopped by the resist roller pair 23, subjected to skew correction, and is then sent out to the transfer nip section at a predetermined image transfer timing. A plurality of conveying rollers for conveying sheets is arranged at appropriate locations along the main conveying path 22F and the reverse conveying path 22B. For example, a discharge roller pair 24 is arranged in a vicinity of the paper outlet 14.

The reverse conveying path 22B is formed between an outer surface of a reversing unit 25 and an inner surface of the rear cover 12 of the main body housing 10. Moreover, the transfer roller 34 and one of the rollers of the resist roller pair 23 are mounted on an inner surface of the reversing unit 25. The rear cover 12 and the reversing unit 25 are respectively rotatable around an axis of a fulcrum section 121 provided at lower ends of the rear cover 12 and the reversing unit 25. When a sheet jam occurs along the reverse conveying path 22B, the rear cover 12 is opened. When a sheet jam occurs along the main conveying path 22F or when removing a unit of the photosensitive drum 31 or the developing device 33 to the outside, the reversing unit 25 is opened in addition to the rear cover 12.

The cooling fan 80 (fan) is arranged at a position on an outer side (left side) of the left frame 10L and to the front of the left frame 10L. In other words, the cooling fan 80 is arranged between the left cover 12L and the image forming section 30 in a horizontal direction (a direction perpendicular to the left cover 12L and the right cover 12R) (refer to FIG. 5). The cooling fan 80 includes a rotating shaft (not shown), a fan motor (not shown), and a plurality of blade members 80H. The fan motor rotates when a drive current is supplied from a power supply (not shown) and rotates the blade members 80H via the rotating shaft. The blade members 80H rotate so as to form a rotational plane that is approximately parallel to the left cover 12L. Due to the rotation of the blade members 80H, air outside the main body housing 10 is taken in from the air inlet 12La and an airflow oriented toward the inside of the main body housing 10 is created.

The substrate unit 70 (circuit board) is arranged on an outer side (right side) of the right frame 10R (FIG. 2). In other words, the substrate unit 70 is arranged between the right cover 12R and the image forming section 30 in the horizontal direction (the direction perpendicular to the left cover 12L and the right cover 12R) (refer to FIG. 5). A plurality of circuit boards is intensively arranged in the substrate unit 70.

With reference to FIG. 4, the substrate unit 70 includes a holding plate 71, a power substrate 72 (substrate), a high-voltage substrate 73 (substrate), and a control substrate 74 (substrate).

The holding plate 71 is a metal plate that defines one side surface of the substrate unit 70 and supports the plurality of substrates described above. The holding plate 71 is arranged between the right cover 12R and the right frame 10R so as to be parallel to the right cover 12R and the right frame 10R (refer to FIGS. 1 and 2).

The power substrate 72 includes a flat plate-like wiring board 72*a* and a plurality of electrical elements 72*b* mounted on the wiring board 72*a*. The power substrate 72 acts as a primary power supply for the image forming apparatus 1. The power substrate 72 generates voltages of 24 V and 5 V. The power supply voltage is supplied to the devices mounted inside of the image forming apparatus 1.

The high-voltage substrate 73 includes a flat plate-like substrate 73*a* and a high-voltage power-supply box 73*b* mounted on the substrate 73*a*. The high-voltage substrate 73 transforms a commercial AC voltage into a predetermined high voltage and supplies the predetermined voltage to the devices mounted inside of the image forming apparatus 1.

The control substrate 74 includes a flat plate-like supporting substrate 74*a* and a control box 74*b* mounted on the supporting substrate 74*a*. Various electrical elements are arranged in the control box 74*b*. The control substrate 74 outputs various control signals to devices mounted inside of the image forming apparatus 1.

As shown in FIG. 4, in the present embodiment, the wiring board 72*a*, the substrate 73*a*, and the supporting substrate 74*a* are arranged adjacent to each other on a large surface of the holding plate 71. In addition, the control substrate 74 and the high-voltage substrate 73 are consecutively arranged in a direction of respective planes thereof so as to be approximately vertical (in an upward direction) with respect to the power substrate 72. As shown, in the present embodiment, a plurality of substrates is arranged as intensively as possible in the substrate unit 70 that is arranged between the right cover 12R and the right frame 10R. Therefore, compared to a case where a plurality of substrates is arranged dispersed inside the main body housing 10, a smaller space is occupied by the main body housing 10. In particular, in the present embodiment, the image forming section 30 is arranged in the internal space S (FIG. 2) and the substrate unit 70 is arranged between the image forming section 30 and the right cover 12R. Therefore, a plurality of substrates can be arranged using the height of the image forming section 30 and an occupied space in the height direction of the image forming apparatus 1 can be minimized.

When a current is supplied to electrical elements mounted on the respective substrates that are intensively arranged in the substrate unit 70 and the electrical elements execute predetermined functions, heat is generated by the electrical elements. When temperatures of the electrical elements rise due to their own heat generation, a malfunction of the respective electrical elements occur and may cause a failure in that operations of the image forming apparatus 1 cannot be executed in a normal manner. In order to solve such issues, in the present embodiment, a cooling air channel F for sending an airflow to units that are heat sources is arranged inside the internal space S.

<First Air Channel>

Figure 5:
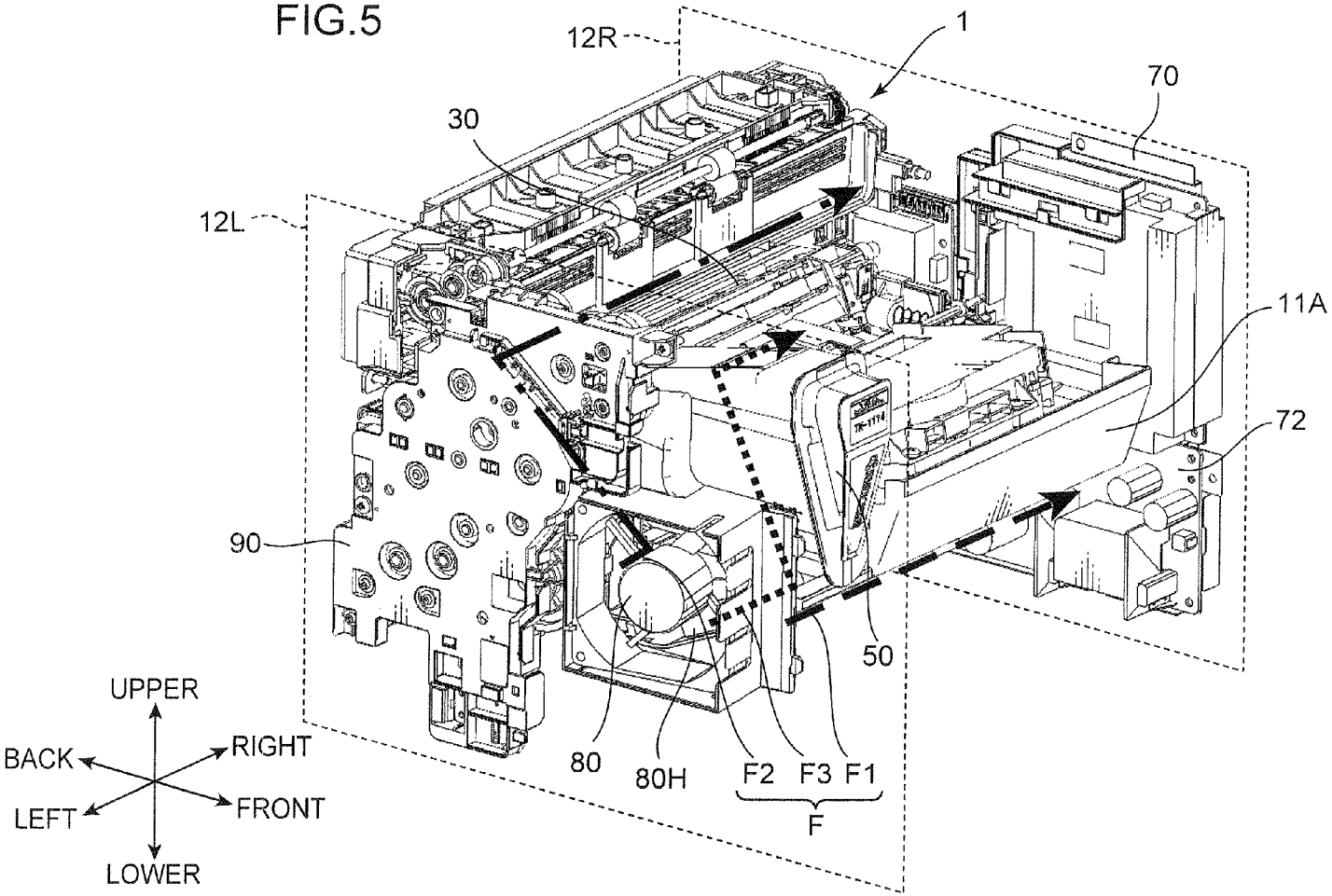
FIG. 5 is a perspective view for explaining a cooling air channel of the image forming apparatus according to an embodiment of the present disclosure.
Figure 6:
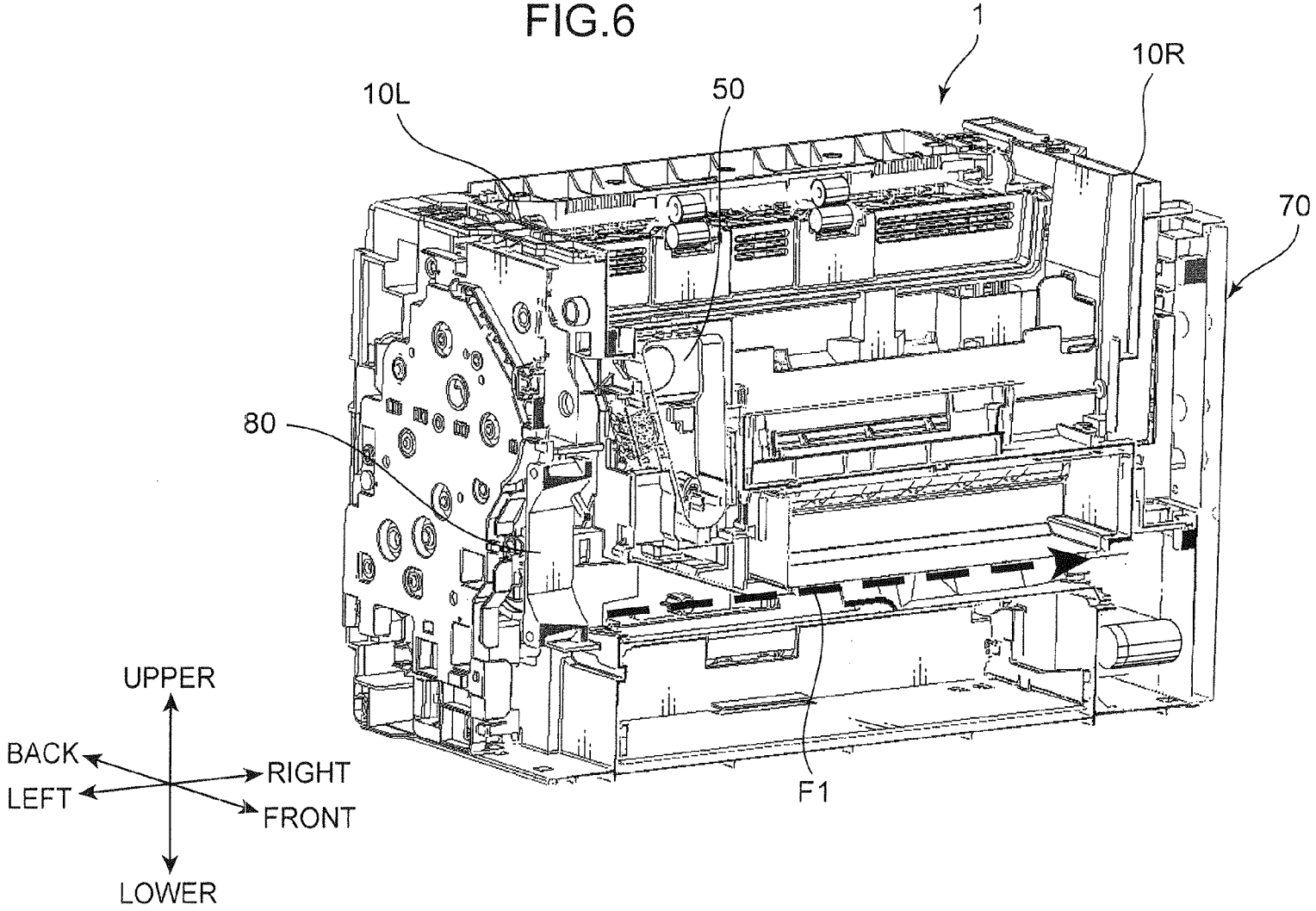
FIG. 6 is a perspective view for explaining a cooling air channel of the image forming apparatus according to an embodiment of the present disclosure.
Figure 7:
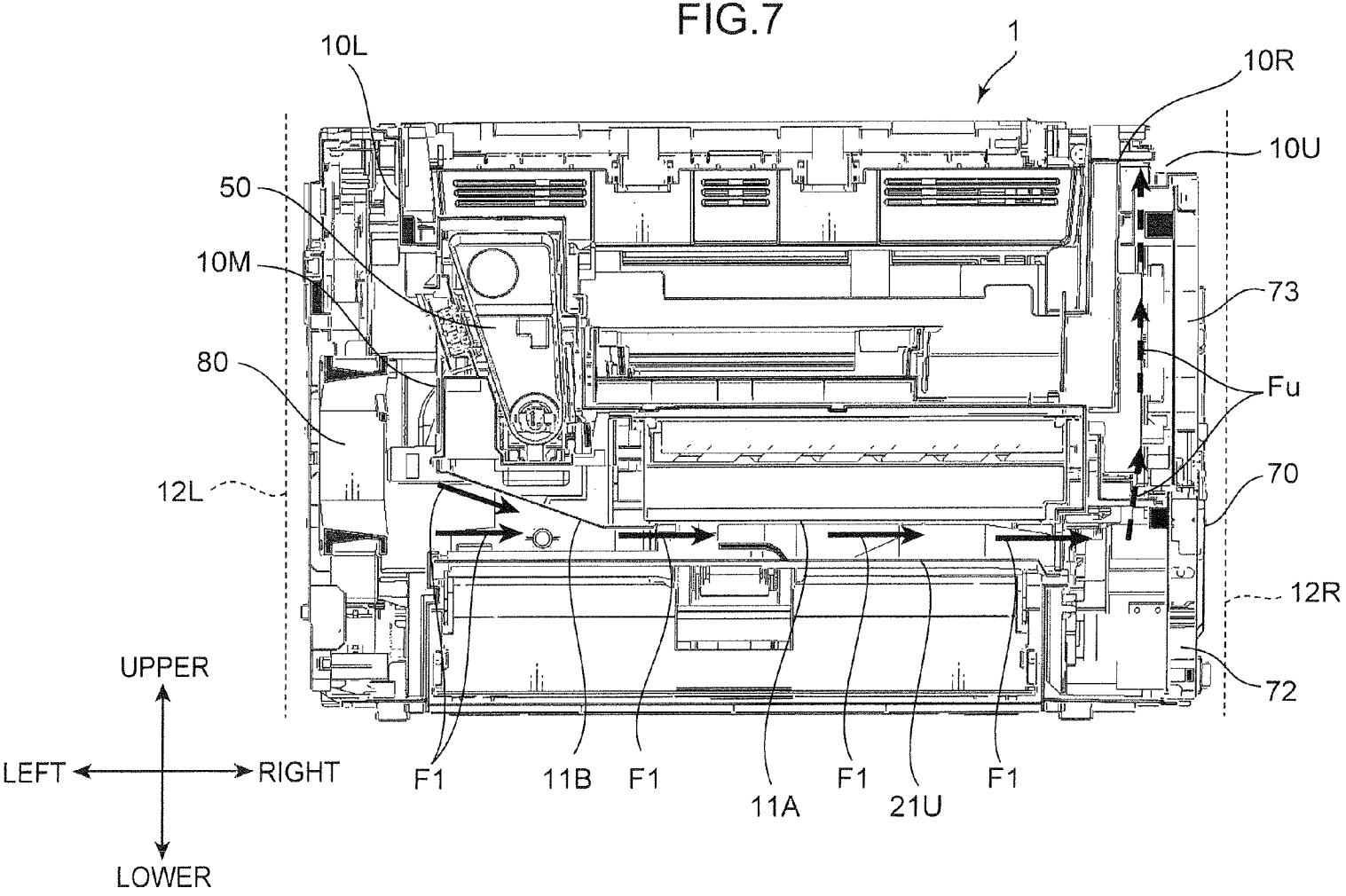
FIG. 7 is a sectional view for explaining a cooling air channel of the image forming apparatus according to an embodiment of the present disclosure.

Next, a first air channel F1 (first cooling air channel) that constitutes the cooling air channel F according to an embodiment of the present disclosure will be described with reference to FIGS. 5 to 7. FIG. 5 is a perspective view showing an arrangement of a plurality of air channels formed inside the main body housing 10, and FIG. 6 is a perspective view showing an arrangement of the first air channel F1 formed inside the main body housing 10. Moreover, in FIG. 6, an arrangement position of the cooling fan 80 is shown without showing the cooling fan 80 itself in order to explicitly indicate the arrangement of the first air channel F1. Furthermore, FIG. 7 is a sectional view showing the arrangement of the first air channel F1 formed inside the main body housing 10.

The first air channel F1 is arranged inside the main body housing 10 so as to extend from the side of the left frame 10L to the side of the right frame 10R. With reference to FIG. 7, the first air channel F1 has an entrance at a position opposing the cooling fan 80 and an exit at a position opposing the substrate unit 70. An upper plane of the first air channel F1 is defined by an inclined cover 11B arranged below the toner container 50 so as to oppose a rotational plane of the cooling fan 80 and by an inner cover 11A installed consecutively to the inclined cover 11B so as to extend to a region that opposes the substrate unit 70. The inclined cover 11B is inclined at a predetermined angle so that the air channel becomes narrower towards the side of the substrate unit 70. In addition, a lower plane of the first air channel F1 is defined by the paper cassette top plate 21U.

An airflow generated by the cooling fan 80 flows into the first air channel F1 from the inclined cover 11B. The airflow is guided inside the internal space S by the first air channel F1 to the side of the right frame 10R and blows against a substrate surface of the substrate unit 70 via an opening (not shown) formed on the right frame 10R. In the present embodiment, the airflow blows against the power substrate 72 that is positioned lowermost among the substrate unit 70. In doing so, the airflow absorbs the heat generated by the respective electrical elements of the power substrate 72. As a result of the absorption of heat, the airflow is warmed and rises along the substrate unit 70 due to a chimney effect (arrows Fu shown in FIG. 7).

The rising airflow comes into contact with the high-voltage substrate 73 and the control substrate 74 which are consecutively arranged in a direction of respective planes thereof with respect to the power substrate 72. The airflow further absorbs heat from the high-voltage power-supply box 73*b* and the control box 74*b*. The airflow warmed as a result of the absorption of heat from the respective substrates further rises and is discharged to the outside of the apparatus from an outlet 10U formed on the main body housing 10.

As described above, according to the present embodiment, an airflow generated by the cooling fan 80 blows against the substrate unit 70 via the first air channel F1. In particular, the airflow blows against the power substrate 72 that is positioned lowermost in the substrate unit 70. Therefore, heat is removed from the power substrate 72, and the warmed air itself generates an updraft. The risen airflow is further capable of cooling the high-voltage substrate 73 and the control substrate 74 arranged above the power substrate 72.

In addition, in the present embodiment, the cooling fan 80 is arranged on the left frame 10L that is on an opposite side to the right frame 10R on which is arranged the substrate unit 70 in which a plurality of substrates is disposed. Therefore, compared to a case where the cooling fan 80 is arranged on the right frame 10R, a degree of freedom of an arrangement space of the cooling fan 80 increases and a large-diameter cooling fan 80 can be selected. Generally, when a same air volume is required, rotating a large-diameter fan at low speed creates less noise than rotating a small-diameter fan at high speed. Therefore, by adopting the configuration described above, the noise created by the fan can be suppressed as much as possible.

Furthermore, in the present embodiment, a lower plane of the first air channel F1 is defined by the paper cassette top plate 21U. Therefore, the first air channel F1 can be formed using an upper surface portion of the paper cassette 21 that is mounted to the main body housing 10.

<Second Air Channel>

Figure 8:
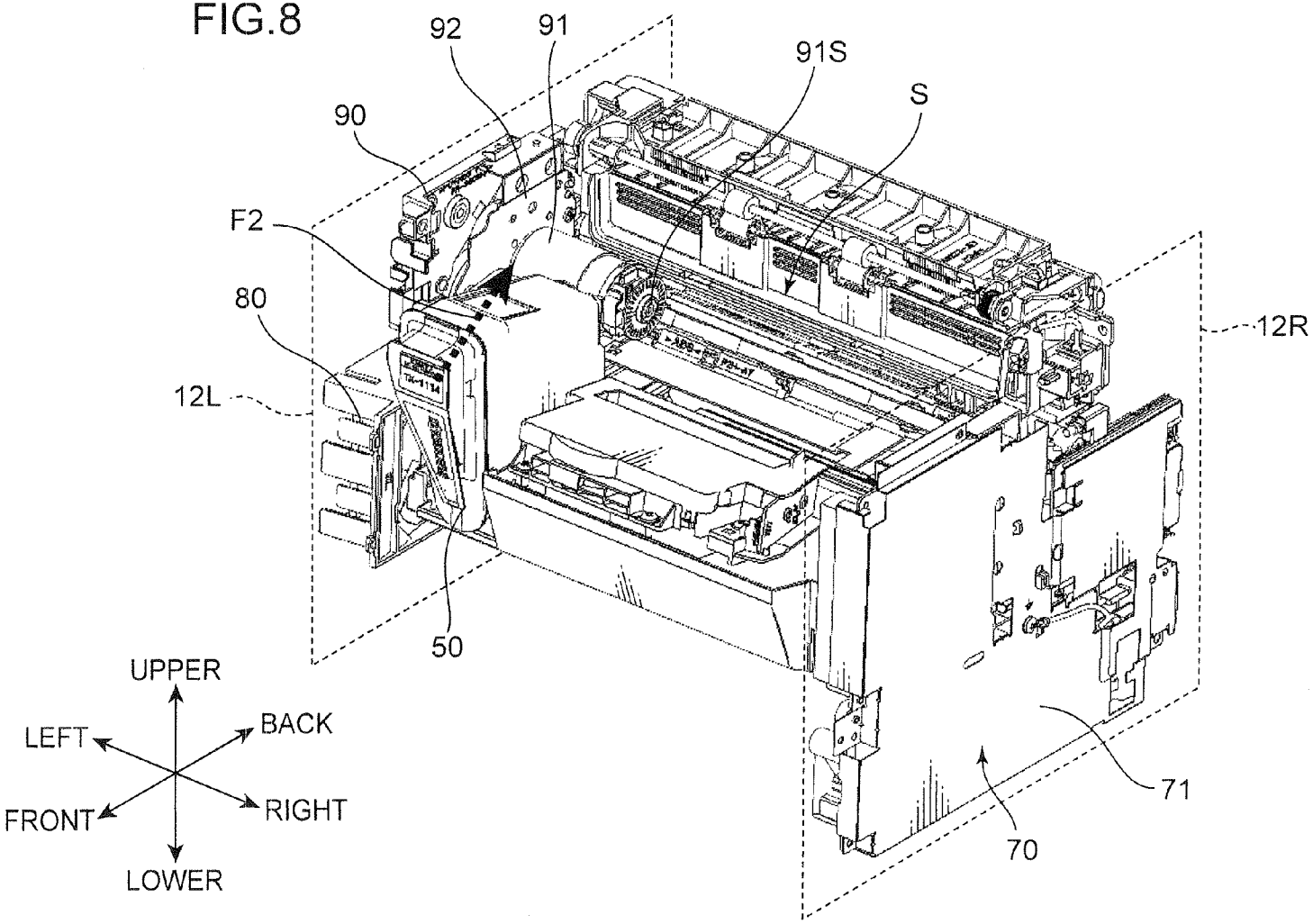
FIG. 8 is a perspective view for explaining a cooling air channel of an image forming apparatus according to another embodiment of the present disclosure.
Figure 9:
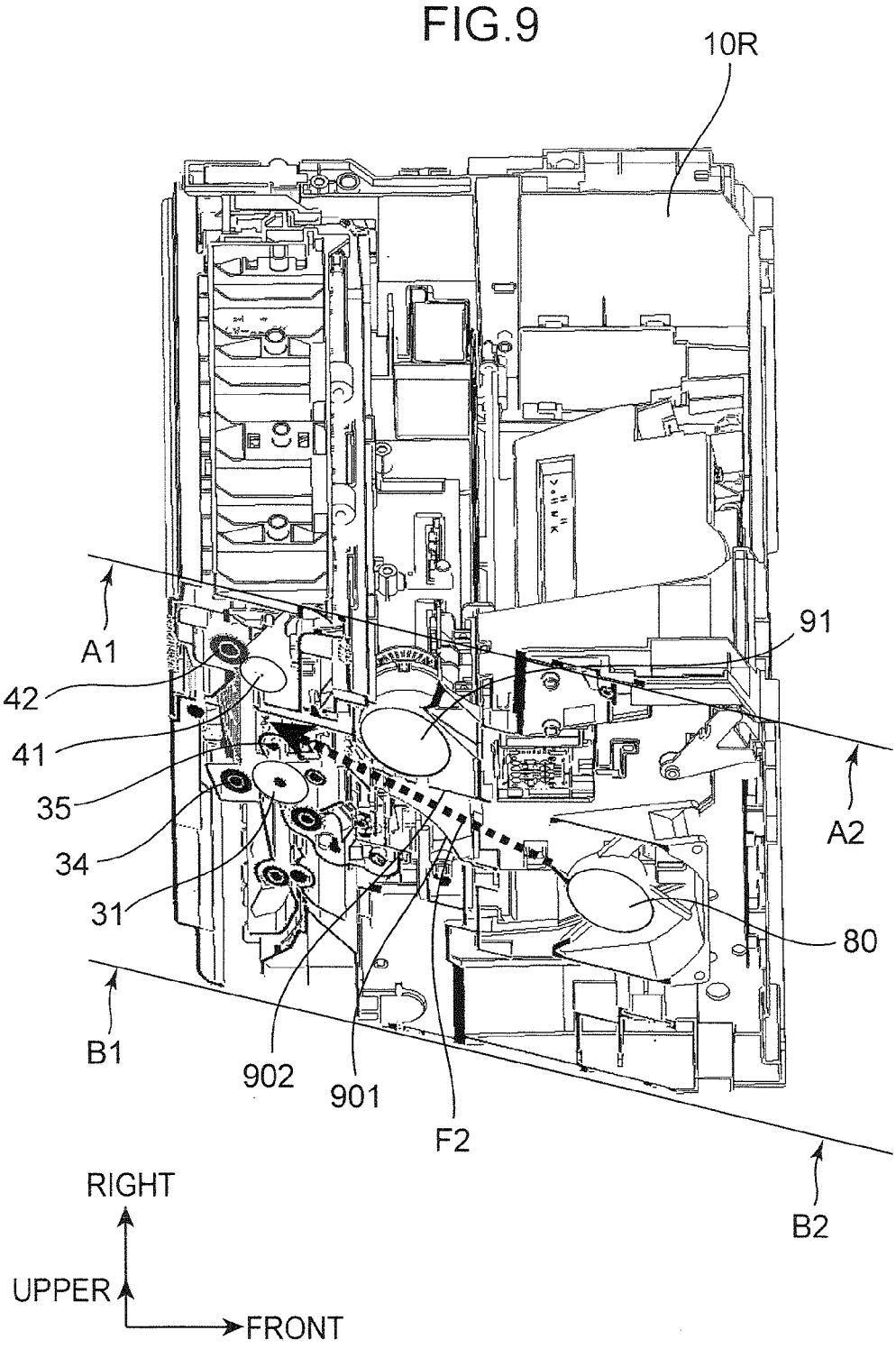
FIG. 9 is a sectional perspective view for explaining a cooling air channel of an image forming apparatus according to another embodiment of the present disclosure.
Figure 10:
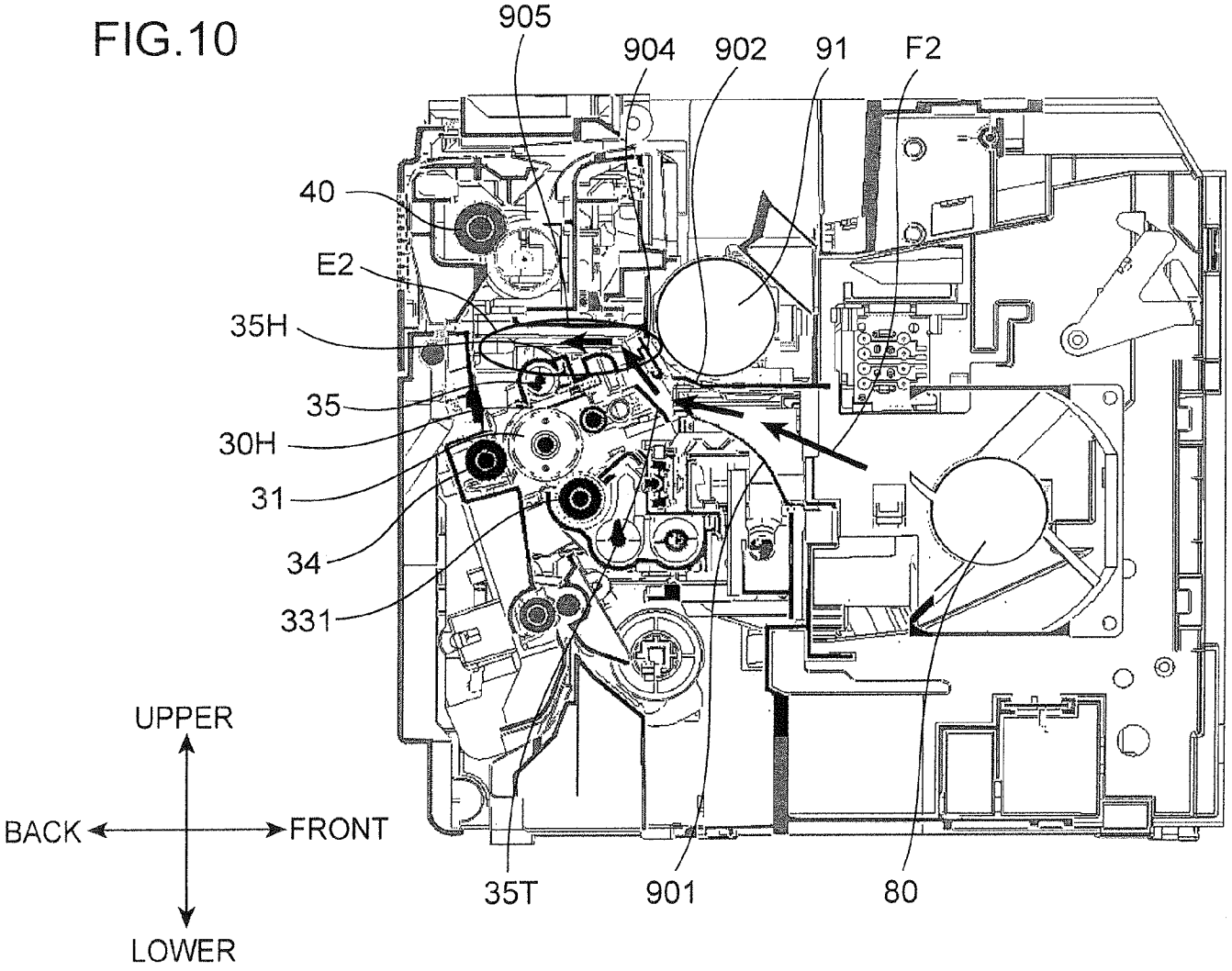
FIG. 10 is a side sectional view for explaining a cooling air channel of an image forming apparatus according to another embodiment of the present disclosure.
Figure 11:
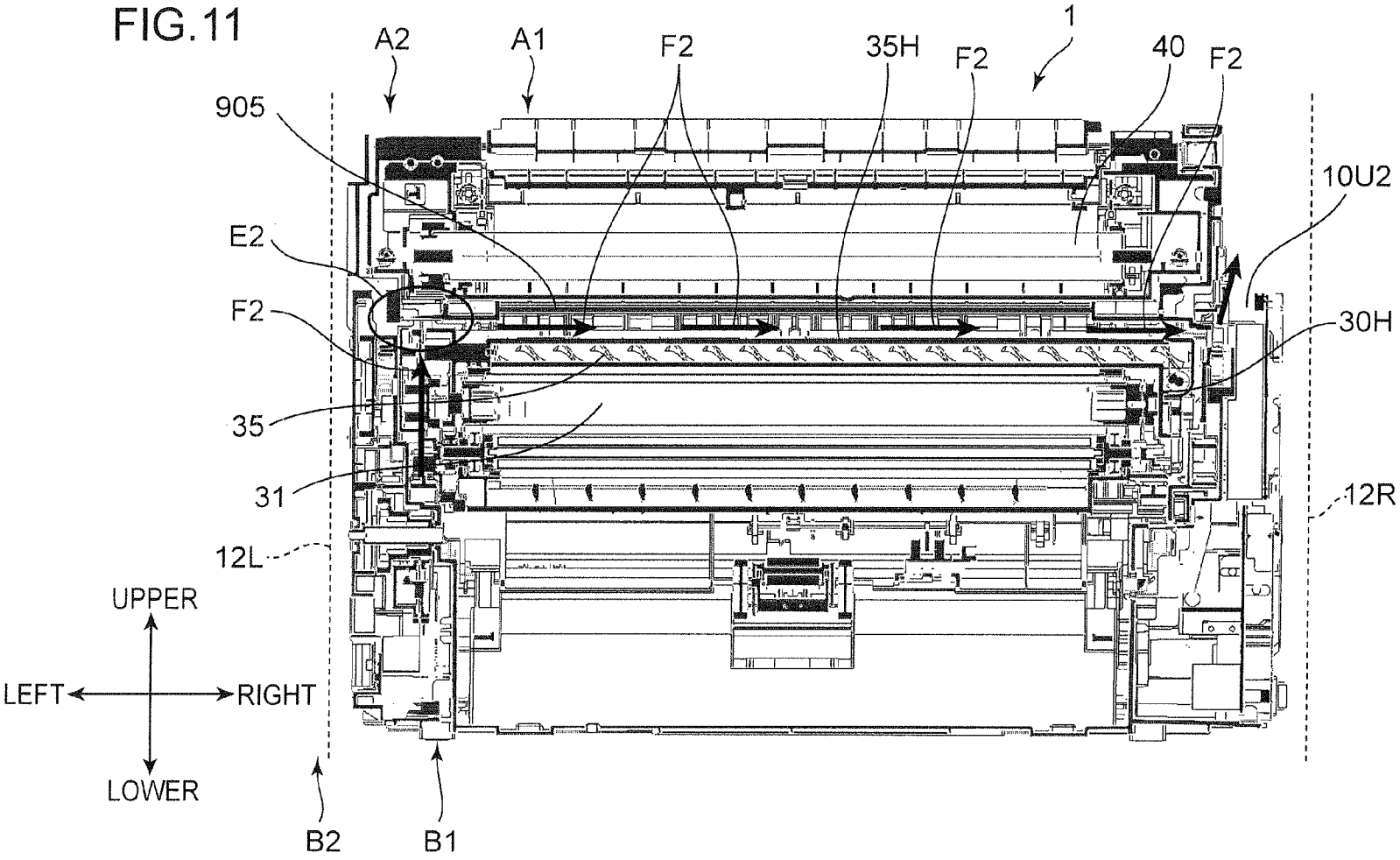
FIG. 11 is a sectional view for explaining a cooling air channel of an image forming apparatus according to another embodiment of the present disclosure.

Next, a second air channel F2 (second cooling air channel, third cooling air channel) that constitutes the cooling air channel F according to the present embodiment will be described with reference to FIGS. 5 and 8 to 11. FIG. 8 is a perspective view of the interior of the image forming apparatus 1 for showing an arrangement of the second air channel F2. In addition, FIG. 9 is a sectional perspective view of the interior of the image forming apparatus 1 that has been cut away along an inclined plane having a predetermined angle of inclination with respect to an upward direction. The inclined plane is a plane that passes through a straight line A1-A2 and a straight line B1-B2 shown in FIG. 9. Respective positions of A1, A2, B1, and B2 are shown in FIG. 11. In addition, FIG. 10 is a side sectional view of the interior of the image forming apparatus 1 for showing an arrangement of the second air channel F2. Furthermore, FIG. 11 is a sectional view of the interior of the image forming apparatus 1 for showing an arrangement of the second air channel F2. With reference to FIG. 5, the second air channel F2 guides a part of the airflow generated by a rotation of the cooling fan 80 toward behind and above the image forming apparatus 1. A positional relationship between the second air channel F2 and peripheral devices will now be described.

With reference to FIGS. 5 and 8, the image forming apparatus 1 includes a drive unit 90, a drive motor 91, and a motor-holding metal plate 92. The drive unit 90 is arranged on an outer side (left side) of the left frame 10L (FIG. 2) and behind the cooling fan 80. The drive unit 90 is constituted by a plate-shape unit which has a predetermined thickness and which internally includes a plurality of gears for transferring drive to the image forming section 30. The drive motor 91 and the motor-holding metal plate 92 are arranged on an inner side (right side) of the drive unit 90. The drive motor 91 has a motor shaft 91S and inputs drive to the gears inside the drive unit 90. In addition, the drive motor 91 has an cylindrical external shape and is arranged so as to protrude toward a central part of the internal space S from the side of the drive unit 90. Furthermore, the motor-holding metal plate 92 is arranged perpendicular to the motor shaft 91S of the drive motor 91. The motor-holding metal plate 92 is arranged along and parallel to the drive unit 90 having a plate shape.

The second air channel F2 is defined in the internal space S by a first partition 901, a second partition 902, a unit top plate 35T, a fourth partition 904, a fifth partition 905, and a cleaner housing 35H (FIGS. 9 and 10).

The first partition 901 and the second partition 902 are arranged on an inner side (right side) of the cooling fan 80 and behind the cooling fan 80. The second partition 902 is arranged approximately horizontally and defines an upper plane of the second air channel F2 on a side of an entrance of the second air channel F2. The first partition 901 is arranged below the second partition 902 so as to oppose the second partition 902, and defines a lower plane of the second air channel F2. The first partition 901 is arranged inclined upward so that the air channel becomes narrower toward the rear of the image forming apparatus 1. Furthermore, a metal plate surface of the motor-holding metal plate 92 forms one side plane (right-side plane) of the second air channel F2 (refer to FIG. 8) in a region where the first partition 901 and the second partition 902 oppose each other. In addition, the second air channel F2 is arranged between the motor-holding metal plate 92 and the drive unit 90.

Furthermore, the second air channel F2 is defined by the fourth partition 904 and the unit top plate 35T further toward the rear of the apparatus than the first partition 901 and the second partition 902. The fourth partition 904 is arranged in proximity to a rear end of the second partition 902 so as to incline upward toward the rear of the image forming apparatus 1. The unit top plate 35T is a part of a wall surface of the drum unit 30H and is arranged in proximity of a rear end of the first partition 901. The unit top plate 35T is arranged so as to incline upward toward the rear of the image forming apparatus 1.

In addition, upper and lower planes of the second air channel F2 are defined by the fifth partition 905 and the cleaner housing 35H further toward the rear of the image forming apparatus 1 than the unit top plate 35T and the fourth partition 904. The fifth partition 905 is arranged in proximity of a rear end of the fourth partition 904. The fifth partition 905 is arranged so as to oppose a bottom surface of the fixing section 40 and to extend from the left frame 10L to the right frame 10R in plan view. The cleaner housing 35H is a part of the wall surface of the drum unit 30H. The cleaner housing 35H covers over the cleaning device 35 from a vicinity of the left frame 10L to a vicinity of the right frame 10R.

Next, an airflow in the second air channel F2 will be described. An airflow that flows into the internal space S due to the cooling fan 80 is guided to the side of the first air channel F1 described earlier and apart of the airflow collides with a wall surface portion 10M shown in FIG. 7. Therefore, a traveling direction of the airflow is bent 90 degrees and the airflow flows toward the side of the second air channel F2.

The airflow is guided below the drive motor 91 by the first partition 901 and the second partition 902 (FIG. 10). At this point, the airflow is guided along a metal plate surface of the motor-holding metal plate 92 (FIG. 8) by the second air channel F2. Therefore, heat of the drive motor 91 which is generated by rotation when a predetermined drive current is supplied to the drive motor 91 is transferred from the metal plate surface of the motor-holding metal plate 92 to the airflow. As shown, in the present embodiment, the metal plate surface of the motor-holding metal plate 92 performs the role of a heat sink. In doing so, due to the metal plate surface of the motor-holding metal plate 92 forming a part of the second air channel F2, the airflow comes into direct contact with the metal plate surface of the motor-holding metal plate 92. As a result, heat transfer from the motor-holding metal plate 92 to the airflow is realized in an efficient manner. In addition, heat is also transferred to the airflow from the drive unit 90 which opposes the motor-holding metal plate 92 and which has a plurality of gears.

Furthermore, the airflow having absorbed heat from the motor-holding metal plate 92 is guided to the rear of the image forming apparatus 1 by the fourth partition 904 consecutively provided to the second partition 902 and the unit top plate 35T consecutively provided to the first partition 901. As a result, the airflow reaches an end on the side of the left cover 12L (a region E2 shown in FIGS. 10 and 11) in a horizontal direction of the fixing section 40 and the drum unit 30H. Subsequently, by colliding with a partition (not shown) that forms a left side plane of the second air channel F2, the airflow changes its traveling direction by an approximately right angle (to a rightward direction) and is guided rightward between the fifth partition 905 and the cleaner housing 35H from an opening E2.

The airflow having entered between the fifth partition 905 and the cleaner housing 35H is guided from the side of the left cover 12L to the side of the right cover 12R as shown in FIG. 11. At this point, the airflow is further warmed by heat transferred from the fifth partition 905. Subsequently, the airflow having passed between the fifth partition 905 and the cleaner housing 35H to the right side forms an updraft and is discharged to the outside of the apparatus from an outlet 10U2 formed on an inner side (left side) of the right cover 12R.

As shown, in the present embodiment, due to the airflow entering between the fifth partition 905 and the cleaner housing 35H, heat transferred to the fifth partition 905 from the fixing section 40 is absorbed by the airflow and discharged to the outside of the image forming apparatus 1. In other words, the airflow provides a space between the fixing section 40 and the cleaner housing 35H with a heat insulating effect. As a result, heat transfer from the fixing section 40 to the cleaner housing 35H is disturbed, so that softening and aggregation of toner recovered by the cleaning device 35 can be suppressed. Therefore, flowability of toner inside the cleaning device 35 is maintained and conveying of toner to the recovery device may be realized in a stable manner.

Furthermore, in the present embodiment, since an outer wall of the cleaner housing 35H that is a part of the drum unit 30H directly constitutes a part of the second air channel F2, cooling of the cleaner housing 35H is effectively promoted.

<Third Air Channel>

Figure 12:
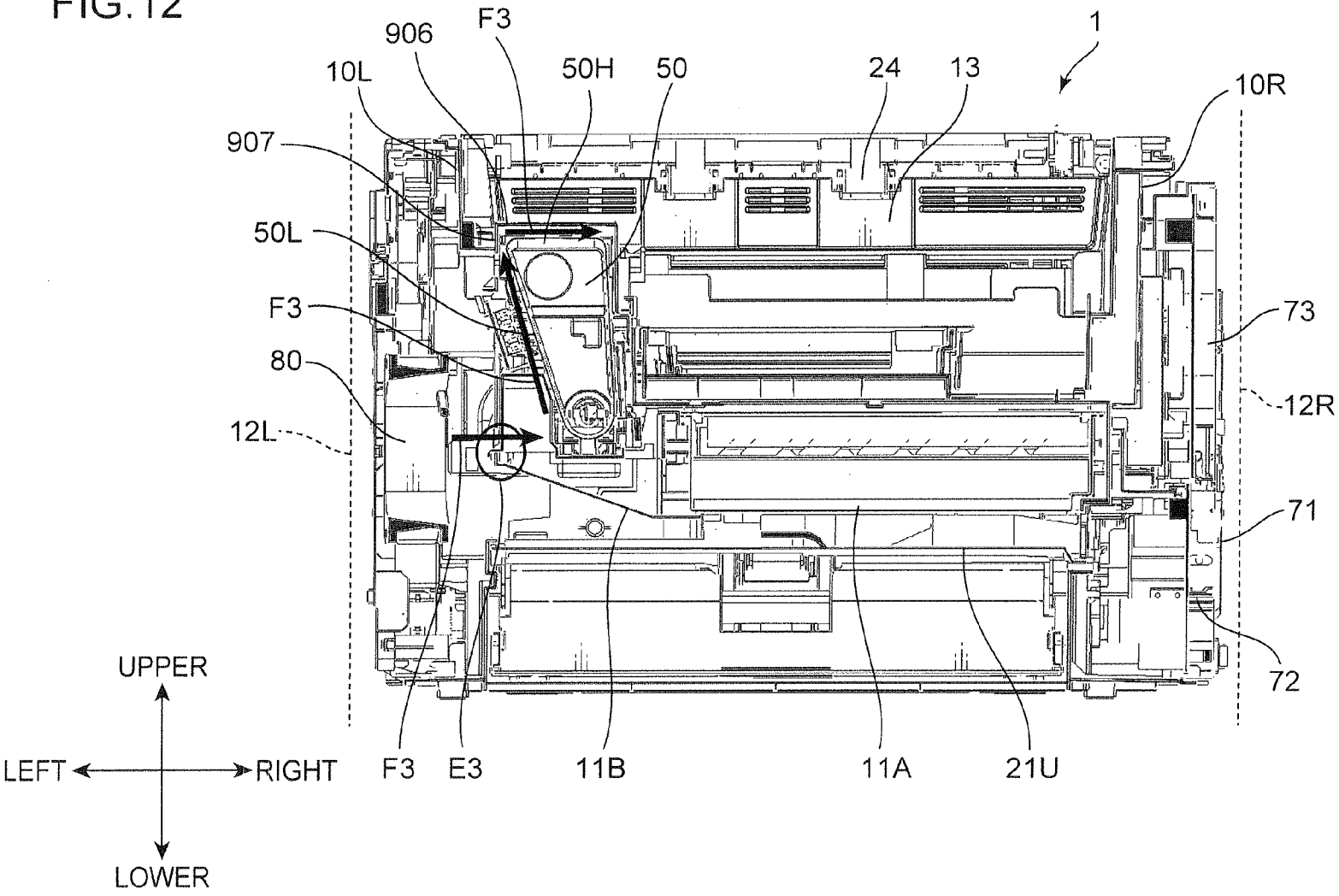
FIG. 12 is a sectional view for explaining a cooling air channel of an image forming apparatus according to another embodiment of the present disclosure.

Next, a third air channel F3 (fourth cooling air channel) that constitutes the cooling air channel F according to the present embodiment will be described with reference to FIGS. 5 and 12. FIG. 12 is a sectional view of the image forming apparatus 1 for showing an arrangement of the third air channel F3. The third air channel F3 functions to guide a part of an airflow having entered to the side of the right cover 12R (rightward direction) from the cooling fan 80 in an upward direction to cool the toner container 50.

The third air channel F3 is defined by a container side wall 50L that is a left side wall of the toner container 50, a partition (not shown) arranged so as to oppose the container side wall 50L on the side of the left frame 10L, a container top plate 50H that is a top plate of the toner container 50, and a sixth partition 906 arranged so as to oppose the container top plate 50H from above. An airflow having flowed into the main body housing 10 due to the cooling fan 80 enters below the toner container 50 from an opening E3 formed on an upper left end of the inclined cover 11B. The airflow collides with the container side wall 50L and is guided upward along the container side wall 50L. By colliding with a partition corner portion 907 arranged so as to oppose an upper end of the container side wall 50L, the airflow then changes its direction by an approximately right angle (to a rightward direction) and is guided between the sixth partition 906 and the container top plate 50H. Subsequently, the airflow is guided from the opening E1 (FIG. 2) to a discharge channel (not shown) arranged in a vicinity of the toner container 50 and is discharged to the outside of the apparatus.

As shown, in the third air channel F3, the airflow flows along the container side wall 50L and the container top plate 50H of the toner container 50. Therefore, the toner container 50 is cooled by the airflow and an increase in temperature of toner housed in the toner container 50 is suppressed. As a result, softening and aggregation of the toner inside the toner container 50 is suppressed. In particular, in the present embodiment, outer walls of the container side wall 50L and the container top plate 50H form a part of the third air channel F3. Therefore, the airflow comes into direct contact with the outer walls of the toner container 50 and cooling of the toner container 50 is promoted.

In addition, in the present embodiment, the container top plate 50H is arranged below the paper ejecting section 13 (refer to FIG. 3). When the temperature of a sheet ejected to the paper ejecting section 13 after being subjected to a fixing process by the fixing section 40 has not been sufficiently lowered, heat is transferred from the paper ejecting section 13 to the toner container 50 inside the main body housing 10. However, as described above, due to the third air channel F3, an airflow flows between the sixth partition 906 and the container top plate 50H arranged below the paper ejecting section 13. Therefore, heat generated from the ejected sheet and transferred to the sixth partition 906 is effectively discharged by the airflow. As a result, softening and aggregation of the toner inside the toner container 50 due to heat from a sheet ejected to the paper ejecting section 13 is suppressed. In particular, due to the third air channel F3 being defined by the outer wall of the toner container 50, an effect of cooling the toner container 50 is improved.

Furthermore, in the present embodiment, the toner container 50 is arranged in the internal space S (refer to FIG. 8) so as to be closer to the left cover 12L than to the right cover 12R. In other words, the toner container 50 is arranged at a position that is as far away from the substrate unit 70 as possible. Therefore, even if toner adhered around the toner container 50 is scattered by the third air channel F3, the toner is prevented from adhering to the electronic components inside the substrate unit 70. In particular, in the present embodiment, the first air channel F1 and the third air channel F3 are divided by the inclined cover 11B and are respectively separately arranged inside the main body housing 10. Therefore, toner having passed through the third air channel F3 is suppressed from joining the first air channel F1 and reaching the substrate unit 70.

Moreover, in another embodiment, the third air channel F3 that cools the toner container 50 may be arranged on a downstream side of an airflow in the internal space S with respect to the first air channel F1 that cools the substrate unit 70. In this case, toner adhered around the toner container 50 is suppressed from being moved toward the substrate unit 70 by the airflow.

While the image forming apparatus 1 having the cooling air channel F according to an embodiment of the present disclosure has been described, the present disclosure is not limited thereto and, for example, modifications such as described below can be adopted.

(1) While a mode in which the motor-holding metal plate 92 and outer walls of the drum unit 30H (cleaner housing 35H) and the toner container 50 directly form a part of the second air channel F2 and a part of the third air channel F3 has been described as a preferred mode in the embodiment above, the present disclosure is not limited thereto. For example, a predetermined partition may be provided between each outer wall and the cooling air channel. In addition, a mode may be adopted in which a thermally-conductive material with high thermal conductivity is arranged between the outer wall of each unit and the cooling air channel.

(2) In the embodiment presented above, a mode has been described in which the second air channel F2 doubles as a cooling air channel that cools the motor-holding metal plate 92 and a cooling air channel that cools between the fixing section 40 and the cleaner housing 35H. Alternatively, a mode may be adopted in which a cooling air channel that cools the motor-holding metal plate 92 and a cooling air channel that cools between the fixing section 40 and the cleaner housing 35H are separately arranged inside the main body housing 10.

(3) In the embodiment present above, a mode has been described in which an airflow guided by the third air channel F3 cools the toner container 50. However, the present disclosure is not limited to this mode. For example, a mode may be adopted in which the airflow guided by the third air channel F3 cools a developer housing or a recovered toner container which internally house toner.

(4) In the embodiment presented above, the substrate unit 70 that is cooled by the first air channel F1 has been configured so as to include a plurality of substrates on the holding plate 71. However, the present disclosure is not limited to this configuration. For example, a configuration may be adopted in which a plurality of electronic components are mounted on a single circuit board. Even in this case, by having the first air channel F1 send an airflow toward a lower part of the circuit board in a vertical direction thereof, an updraft is created in the airflow and electronic components arranged above the circuit board are cooled effectively.

(5) In the embodiment presented above, a cooling air channel F has been described in a mode having the first air channel F1, the second air channel F2, and the third air channel F3. However, the present disclosure is not limited to this mode. For example, a mode may be adopted in which only the first air channel F1 is arranged. Alternatively, a mode may be adopted in which the second air channel F2 or the third air channel F3 is combined with the first air channel F1.

What is claimed is:

1. An image forming apparatus comprising:

a chassis having a first cover surface and a second cover surface that is opposite to the first cover surface, the first cover surface and the second cover surface extending in a vertical direction;

a frame disposed inside the chassis, the frame including a first frame erected along the first cover surface and a second frame erected along the second cover surface;

an image forming section arranged in an internal space between the first cover surface and the second cover surface of the chassis and performing an image forming process on a sheet, the image forming section being supported by the first frame and the second frame and including an image carrier for carrying a toner image and a developing device supplying toner to the image carrier and an image carrier unit that holds the image carrier;

a fixing unit arranged in the internal space above the image carrier, the fixing unit performing a fixing process on a sheet on which the toner image has been transferred and being supported by the first frame and the second frame;

a fan arranged on the first frame between the first cover surface and the first frame and being rotationally driven to cause an airflow to flow into the internal space;

an air inlet arranged on the first cover surface, the airflow flowing into the internal space through the air inlet by rotation of the fan;

a circuit board vertically arranged on the second frame between the second cover surface and the second frame;

a first cooling air channel arranged in the internal space and sending the airflow flowing into the internal space through the fan toward the circuit board in the horizontal direction;

a toner housing section arranged closer to the first frame than to the second frame and above the fan in the internal space and housing toner, the toner housing section including a main body that defines a primary storage location of toner, a cylindrical section that extends from a lower part of one side surface of the main body and a toner outlet on a lower surface of a tip of the cylindrical section for supplying the toner to the developing device;

a toner housing cooling air channel that guides the airflow flowing into the internal space through the fan along the toner housing section in the vertical direction; and an image carrier unit cooling air channel that guides the airflow to between the image carrier unit and the fixing unit.

2. The image forming apparatus according to claim 1, wherein the first cooling air channel sends the airflow horizontally toward portion of the circuit board that is at a vertically lower position on the circuit board.

3. The image forming apparatus according to claim 1, wherein the circuit board is formed of a plurality of substrates, and the first cooling air channel sends the airflow toward the substrate at a vertically lower position among the plurality of substrates.

4. The image forming apparatus according to claim 1, further comprising:

a motor which inputs drive to the image forming section;

a holding plate which supports the motor; and a second cooling air channel which guides the airflow along the holding plate.

5. The image forming apparatus according to claim 1, wherein a part of the third cooling air channel is formed by a unit outer wall of the image carrier unit.

6. The image forming apparatus according to claim 1, wherein a part of the toner housing cooling air channel is formed by an outer wall of the toner housing section.

7. The image forming apparatus according to claim 1, wherein the first cooling air channel and the toner housing cooling air channel are respectively separately arranged in the internal space.

8. The image forming apparatus according to claim 1, wherein the first cooling air channel is between the upper surface section of the paper cassette and the toner housing section.

9. An image forming apparatus comprising:

a chassis having a first cover surface and a second cover surface that is opposite to the first cover surface, the first cover surface and the second cover surface extending in a vertical direction;

a frame disposed inside the chassis, the frame including a first frame erected along the first cover surface and a second frame erected along the second cover surface;

an image forming section arranged in an internal space between the first cover surface and the second cover surface of the chassis and performing an image forming process on a sheet, the image forming section being supported by the first frame and the second frame and including an image carrier for carrying a toner image and a developing device supplying toner to the image carrier;

a fixing unit arranged in the internal space above the image carrier, the fixing unit performing a fixing process on a sheet on which the toner image has been transferred and being supported by the first frame and the second frame;

a fan arranged on the first frame between the first cover surface and the first frame and being rotationally driven to cause an airflow to flow into the internal space;

an air inlet arranged on the first cover surface, the airflow flowing into the internal space through the air inlet by rotation of the fan;

a circuit board vertically arranged on the second frame between the second cover surface and the second frame;

a first cooling air channel arranged in the internal space and sending the airflow flowing into the internal space through the fan toward the circuit board in the horizontal direction;

a toner housing section arranged closer to the first frame than to the second frame and above the fan in the internal space and housing toner, the toner housing section including a main body that defines a primary storage location of toner, a cylindrical section that extends from a lower part of one side surface of the main body and a toner outlet on a lower surface of a tip of the cylindrical section for supplying the toner to the developing device;

a toner housing cooling air channel that guides the airflow flowing into the internal space through the fan along the toner housing section in the vertical direction; and a paper ejecting section disposed on an upper surface of the chassis to which the sheet is ejected, wherein the toner housing section includes a top plate positioned below the paper ejecting section; and the toner housing cooling air channel further guides the airflow between the paper ejecting section and the top plate.

* * * * *